United States Patent [19]

Farre

[11] 3,992,142

[45] Nov. 16, 1976

[54] PRINTING FABRIC

[76] Inventor: Luis Farre, 3, Irineo St., Tarrasa, Barcelona, Spain

[22] Filed: Oct. 16, 1974

[21] Appl. No.: 515,385

[52] U.S. Cl. ..... 8/16; 8/70; 8/149; 68/200; 118/69; 118/403; 118/419; 427/280; 427/434 R; 427/439

[51] Int. Cl.[2] ..... D06P 1/90; D06P 3/87; D06P 7/00

[58] Field of Search ..... 8/16, 70, 149; 117/39; 427/280, 439, 434

[56] References Cited

UNITED STATES PATENTS

| | | | |
|---|---|---|---|
| 112,544 | 3/1871 | Carson | 8/16 |
| 324,860 | 8/1885 | Martin | 117/39 |
| 492,933 | 3/1893 | Bellamy | 8/16 |
| 1,668,934 | 5/1928 | Bracewell | 8/16 |
| 1,773,169 | 8/1930 | Cadgene | 8/16 |
| 1,846,845 | 2/1932 | Clark | 8/16 |
| 1,931,667 | 10/1933 | Loetscher | 8/16 |
| 2,140,498 | 12/1938 | Dreyer | 117/39 |
| 3,758,331 | 9/1973 | Denojean | 117/39 |

*Primary Examiner*—Ronald W. Griffin
*Attorney, Agent, or Firm*—William Anthony Drucker

[57] ABSTRACT

A process and apparatus system for continuous printing of fabric includes a water surface in a vat on which dye materials are formed into a uniform film and fabric is contacted therewith. The film forms in a tiltable tray like container extending the full width of the vat of water and dyes are distributed thereon by compressed air nozzles which tilt with the tray devices. A baffle feeds fabrics into the water during the process.

1 Claim, 4 Drawing Figures

PRINTING FABRIC

This invention process is intended to obtain the continuous printing of fabrics by means of an original system, which achieves a very special and novel finish effect on the printed fabrics, thus being of noteworthy industrial interest.

As is known, the different systems used to obtain continuous printing are based on the use of very complicated and expensive machines, as well as on the reproduction of the drawing by means of notably complicated systems.

This printing process eliminates the use of said complicated and expensive means, transforming the printing operation into a process of great simplicity and of reduced cost, while at the same time permitting the attaining of highly interesting decorative effects on the printed fabrics.

The subject of this Patent is based essentially on the continuous printing of fabrics by the direct application to the fabric to be printed of a sheet resulting from the combination of colors (dyes), or the direct transfer by means of a liquid sheet on which was deposited the layer of colors (dyes), prior to its direct transfer onto the ply of fabric.

For the actual implementation, there is arranged a vat provided with a liquid mass on which is being deposited in a continuous manner a layer constituted of different dyes, which covers entirely the sheet of water, being distributed whimsically, and there also being arranged partially immersed in said vat the fabric to be printed, which latter is unwound from a bobbin or coil and forced to pass through the liquid by means of a baffle plate of a special form, after which said imprinted fabric is gathered in an upper chamber, in which the drying of the printing is performed by means of a hot airstream and a coil containing hot water arranged in the proximity of the printed fabric during its passage along the length of the drying chamber.

For the purpose of better comprehension there are attached, as example, some explanatory drawings of this Patent.

The Figures depict apparatus systems according to the present invention.

Figure 1:
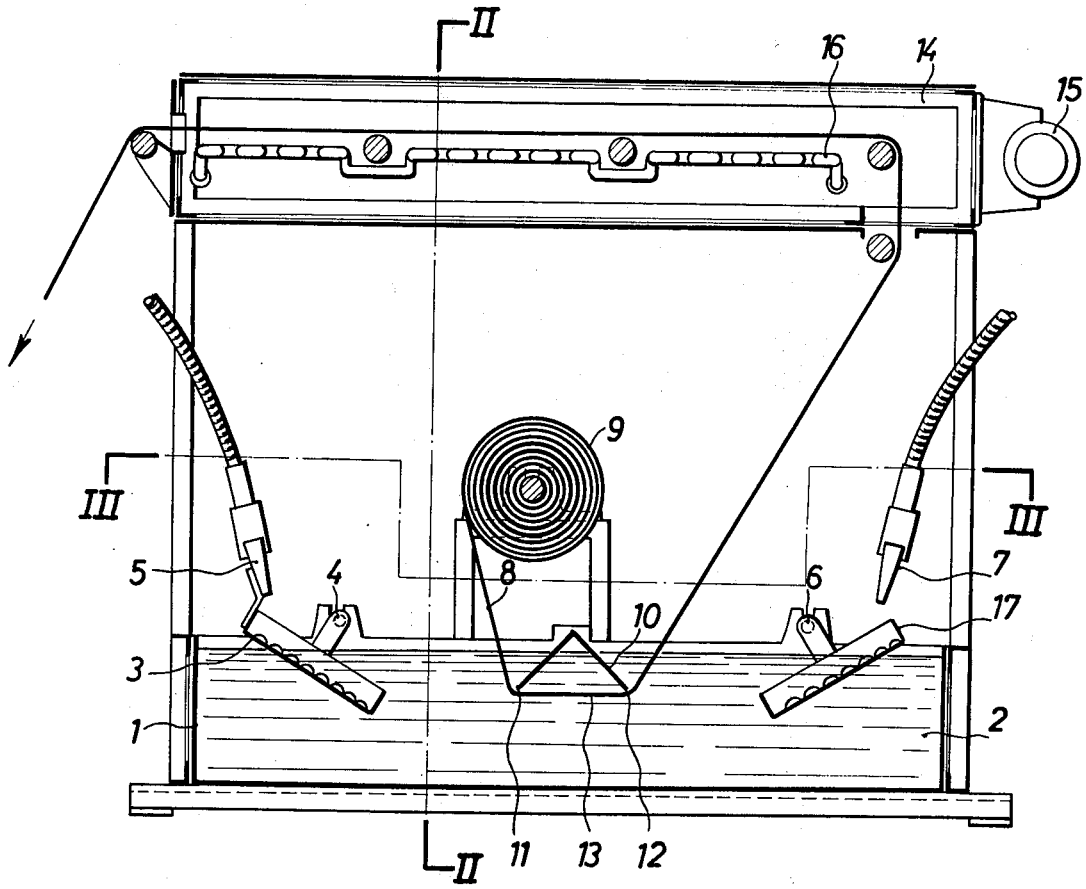
FIG. 1 is a view in lateral elevation of an installation to carry through this process, shown in schematic form.
Figure 3:
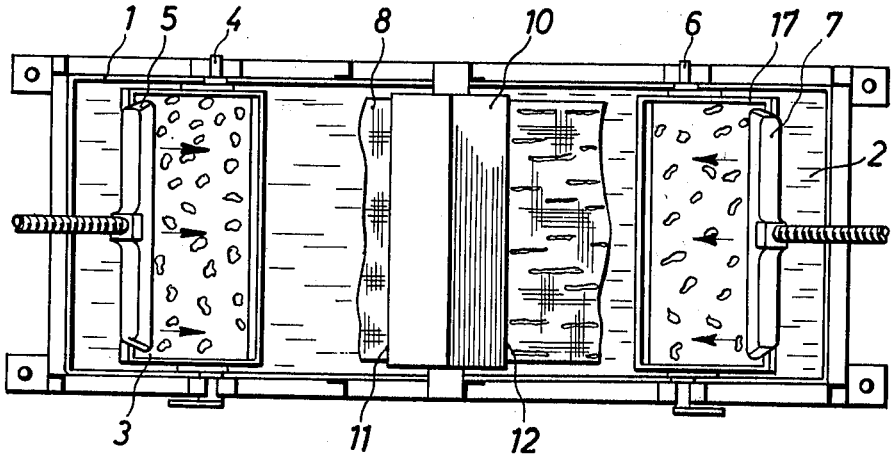
FIG. 3 is a detail in plan.
Figure 2:
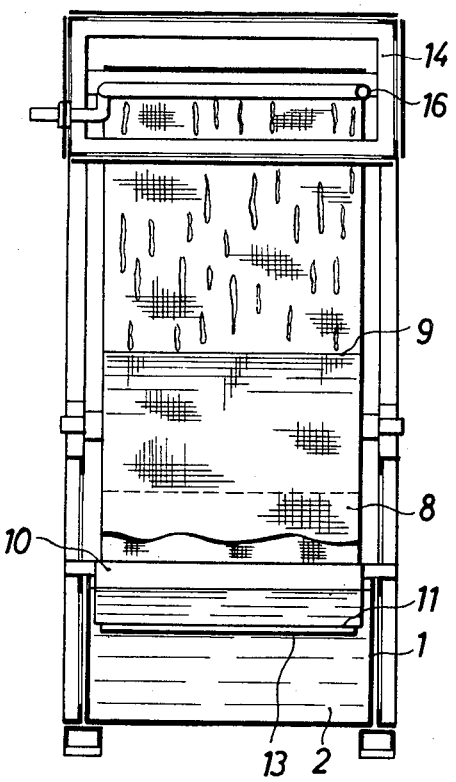
FIG. 2 is a section in front elevation of the installation.
Figure 4:
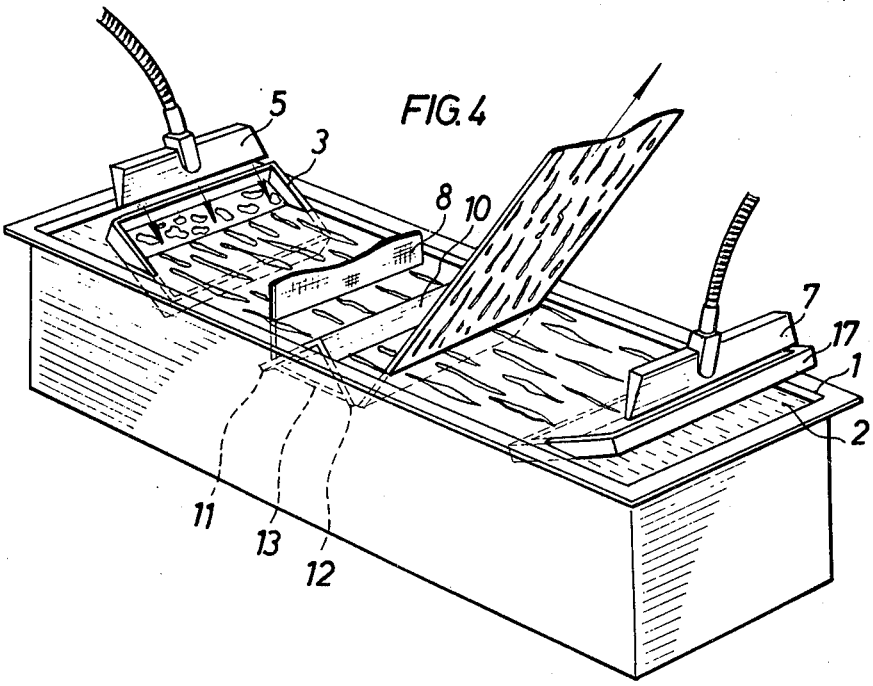
FIG. 4 is a detail in perspective.

As shown in these figures, the process which is the subject of this Patent, is based on the arrangement of a vat 1 intended to contain a liquid mass 2, preferably water, on the surface of which there is placed a sheet of much lesser thickness formed by inks or dyes poured directly by means of an inclined support container 3, which is titled over a cross shaft 4 and carries in back of it a nozzle 5 for injecting air, FIG. 4, which extends across the entire width of the vat, in such a manner that the dyes or inks provided inside said vat are spread by the action of the air injected through nozzle 5 onto the sheet of liquid 2.

The system for forming the surface layer of dyes can be duplicated at the other end of vat 1 by means of a second; dyes pouring trough 17, arranged rotatably on a cross shaft 6 and with a second nozzle 7 which also extends across the entire width of the vat 5. By means of this variant it is possible to effect the reprinting upon exiting of the fabric, after the printing at the entrance.

The transfer of the sheets of dyes carried on the water contained in vat 1 is done in direct form by the immersion of the fabric to be printed 8, which is unwound from a coil or bobbin 9 arranged transversally above the vat 1 and is forced to immerse in the liquid contained in said vat 1 by means of a baffle plate, which may take the form shown in said figure, that is to say a dihedron 10 whose two lower edges 11 and 12 brings about a level run 13 of the fabric 8, which picks up the sheets of dye at one and at the other side of said baffle plate, originating from the aforesaid two systems.

The fabric which has picked up the sheet (layer) of dyes, that is, it is already printed, passes to the inside of a drying chamber 14 situated in the upper part, into the inside of which drying chamber hot air is introduced by way of a fan 15 and in which is also arranged a coil in horizontal form 16, immediately under the fabric 8, in such a manner that the surface layer of dyes is being dried and thereby the printing process is completed.

What is claimed is:

1. In a process for the continuous printing on fabrics in which a surface layer of dyes is distributed on the surface of a liquid in a vat; the dyes are transferred directly onto a continuous strip of fabric which is partially submerged in said vat whereby the fabric picks up a dye coating directly; and thereafter the fabric is continuously dried by hot air and radiation, wherein the dyes on the surface of the liquid are distributed thereupon by the steps of firstly blowing air thereon through a nozzle in an adjustably tilted trough structure across the entire liquid width, partially submerging the structure in the liquid; and tilting said trough, wherein a fabric strip to be printed is immersed in the liquid containing a surface film of dyes and is guided therein by a baffle plate system to provide a level run of the fabric.

* * * * *